United States Patent [19]

Forman

[11] 4,203,270

[45] May 20, 1980

[54] HIGH SPEED TEAR TAPE APPLICATOR FOR SHRINK WRAP FILM PACKAGING

[76] Inventor: Harold Forman, P.O. Box 363, Conshohocken, Pa. 19428

[21] Appl. No.: 907,798

[22] Filed: May 19, 1978

[51] Int. Cl.[2] ..... B32B 31/00; B31F 5/00; B31B 1/22; B65B 61/18

[52] U.S. Cl. ..... 53/133; 156/554; 156/510

[58] Field of Search ..... 156/510, 513, 554, 512; 53/133

[56] References Cited

U.S. PATENT DOCUMENTS

| | | | |
|---|---|---|---|
| 3,069,303 | 12/1962 | Scholle | 156/513 |
| 3,226,281 | 12/1965 | Carpinella | 156/513 |
| 3,272,673 | 9/1966 | Focke | 156/512 |
| 3,441,462 | 4/1969 | Bogen | 156/513 |
| 3,846,218 | 11/1974 | Wootten | 156/513 |

*Primary Examiner*—Douglas J. Drummond
*Attorney, Agent, or Firm*—Ruth Moyerman

[57] ABSTRACT

Method and apparatus are disclosed having particular utility in connection with packages overwrapped with heat shrinkable film and which include a tear-tab opening. The apparatus includes means to sever the film and tape together by the use of a cutting tool. The cutter is generally pen-shaped, the nib portion forming the cutting surface. Other parts of the apparatus include a tab roller which provides variable control capability to allow the tab to be positioned at a pre-selected place on the package. The tear tape tab produced by the apparatus and method of this invention eliminates the need for melt re-inforcing and is applicable to high speed operations of either the continuous or reciprocating kind.

4 Claims, 12 Drawing Figures

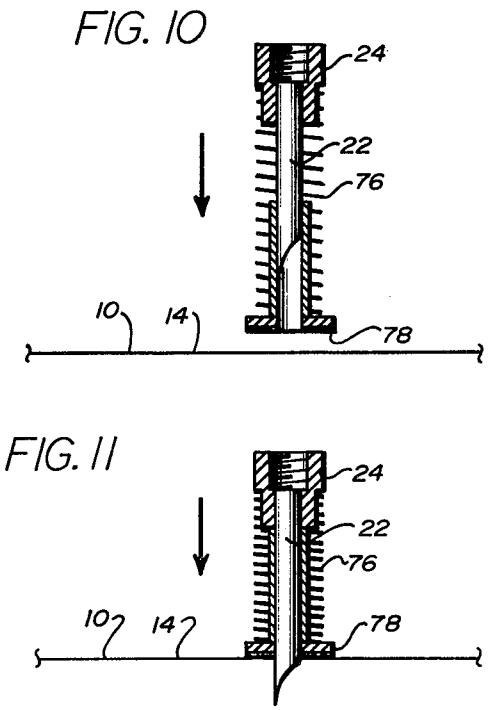
FIG. 10
FIG. 11
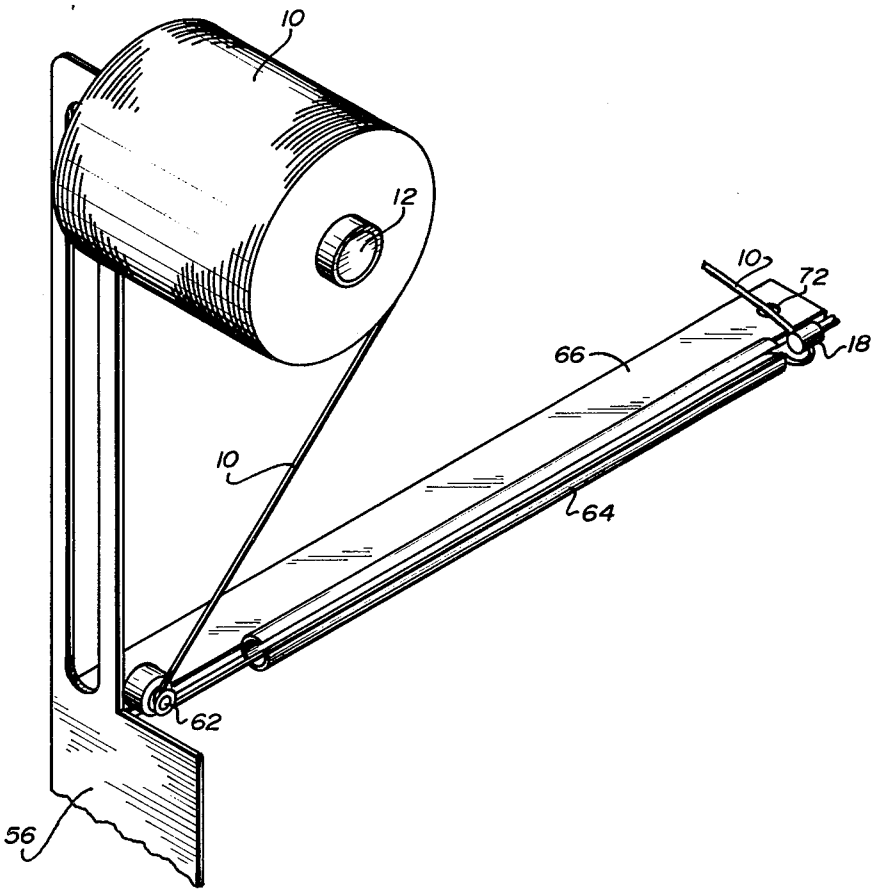
FIG. 7

HIGH SPEED TEAR TAPE APPLICATOR FOR SHRINK WRAP FILM PACKAGING

BACKGROUND OF THE INVENTION

1. Field of the Invention

This invention relates to paper-like receptacles and more particularly to tear tape tab openers in shrink wrap packaging.

2. Prior Art

The so-called shrink wrap packaging of articles is in common usage today. Involved is a thermo-plastic, generally an axially oriented film, which shrinks with the application of heat to tightly encompass a package. This type of packaging has become a common method of packaging everything from food products to toys. Opening these film-encased packages has led to a great and increasing interest in the use of "tear tape". My own prior patents such as U.S. Pat. Nos. 3,456,780, 3,668,061 and 3,468,412, 3,499,260 etc. generally demonstrate the current state of the art in shrink wrap film packaging. These aforementioned patents are herewith incorporated by reference.

The consumer of today has shown the greatest interest and acceptance to shrink wrap packaging in which a tear tape with tab is provided to enable the package to be more easily opened. The incorporation of a tear tape and tab in shrink wrap packaging is difficult. Prior art tear tape tabs have generally suffered from a variety of problems associated with either their manufacture or their ultimate use.

In the manufacturing of shrink wrap with tear tapes, it is necessary to produce a tear tape which, in use, will not rip off of the package unilaterally, leaving the package still wrapped. Also, the tear tape must incorporate a tab starter which will not become dislodged or broken prior to its use. Furthermore, the tear tape, when pulled, must fully open the package without lateral tearing of the film.

A further problem heretofore unsolved relates to positioning a tear tape tab on the package. It is important to have the tear tape tab at the correct place on the package to achieve the best results and this position varies from package to package depending on the overall size, bulk, configuration, etc. of the article to be wrapped. Since a user may wish to wrap a variety of different articles, flexibility in positioning the tab is essential.

As to the tab itself, it has been found that a tab-type opening formed from a horseshoe-shaped severing of the film and tape together produces an acceptable tear tape tab. U.S. Pat. No. 3,362,617 to Gieber is an example of a prior art tear tape tab of this type. However, as Gieber himself points out, the region around the edge of the cut is subject to heavy stress and to prevent stretch tearing or destruction of the wrapping film, including premature tear, Gieber recommends reinforcing around the cut. His solution is a melt cutting whereby, after a hot wire severing of film and tape, the plastic melt resolidifies and beads around the opening.

Finally, there is a problem of adapting prior art techniques to a high speed operation, either reciprocating or continuous. Melt cutting, for example, has proven totally unsatisfactory in high speed operations because significant time must be allowed for the melt and resolidification to take place.

All of the foregoing demonstrate the continuing need, where tear tape, shrink wrapper film is employed, for improved apparatus and methods, especially those adaptable for use in high speed application.

SUMMARY OF THE INVENTION

The aforementioned prior art problems are solved by the apparatus and method of this invention wherein utilizing said method and apparatus, wrapped packages may be produced at high speeds. The wrapped package incorporates a tear tape and tab in a shrink wrap film application wherein a tab is produced by cutting, not melting, and furthermore a unique tab shape results.

In this invention, apparatus is disclosed which may be satisfactorily utilized with a host of different types of articles to be packaged, is low cost and portable, and which is readily adaptable to fit a variety of onsite plant packaging operations.

A novel punch cutter is utilized for the purpose of forming a tab by the cutting through of both film and tape together. The punch cutter includes a tubular shank portion and a nib cutting portion. The nib cutting portion is formed from exposed edges of the shank portion. The shape of nib has the same appearance as if generally a plane or disk-shaped segment was removed from the shank diagonally to the longitudinal axis of the shank. The design of the cutter may be characterized as pen-shaped. The cutting portion comes to a point (tip) and it is this tip which first enters and begins the severing of the film and tape. One embodiment of the cutter makes an arcuate cut. In an alternate embodiment, the cutter includes a slotted section and part of the cutting edge is curled inward so that the arcuate cut to form the tab is modified to include a curled part which lies along the tape edges and which provides reinforcement along the tear line. Cutting may be, for example, at right angles to the film. With the cutter mounted in this position, rapid reciprocating cutting results since no melting is involved.

I have, however, further discovered that by modifying the angle at which the cutter is mounted an improvement is realized whereby the cutter becomes useful in a continuous high speed operation. This improvement is a further improvement over the reciprocation procedure.

Thus, in the high speed reciprocating situation in which the film is halted to perform the necessary cutting step, the cutter may be conveniently mounted at right angles to the film. Alternatively, if a high speed continuous operation is preferred, I have discovered that by mounting the cutter of my invention at an acute angle, it is possible to punch-cut tab openings without halting the film. The tab produced is perfectly shaped, having no elongation or tearing as would commonly be associated with a tab cutting operation performed on moving film.

Furthermore, I have also discovered a method and apparatus by which, with the utilization of tab roller means, it is possible for me to adjust the place on the package at which the tab appears. The tab roller receives the advancing tab cut film and tape and, by adjusting the setting of the tab roller, film advancing to a package-wrapping station will arive at the package-wrapping station with the tab-cut longitudinally adjusted to cause it to appear at any pre-selected point on the package.

The cutter of this invention not only eliminates the need for melt cutting but also has an advantage of obviating the need for a die portion to be utilized with the cutter. Advancing film and tape to be cut pass over a support plate with a hole in it of sufficient size to receive at least the nib portion of the cutter. The cutter, in operation, simply severs the tape and film with the nib section passing through tape and film and into the opening in the plate.

Accordingly, it is an object of this invention to provide means by which a tear tape opening may be made in a shrink wrap film and tape which eliminates the need for melt reinforcing.

It is another object of this invention to produce a tab opening means by a cut-severing of said film and tape.

It is another object of this invention to produce a tear tape tab which eliminates the need for collateral reinforcing.

It is a further object of this invention to provide apparatus suitable for the production of high speed tear tape shrink packaging.

It is yet again an object of this invention to provide a tear tape tab-forming operation which is suitable for both continuous and reciprocating applications.

It is yet another object of this invention to provide an apparatus with a variable control capability to allow the tab positioning on the wrapped package to be placed as a matter of choice.

These and other objects will be more readily ascertainable to one skilled in the art by reference to the accompanying drawings and exemplary embodiments that follow.

BRIEF DESCRIPTION OF THE DRAWINGS

FIG. 7 is an enlargement of part of the apparatus showing the tape feeder portion.

FIG. 10 shows an alternate embodiment of the cutter of this invention including film gripping means.

FIG. 11 shows another view of the cutter of FIG. 10.

DETAILED DESCRIPTION

Figures 1, 2, 3, 4, 5, 12:
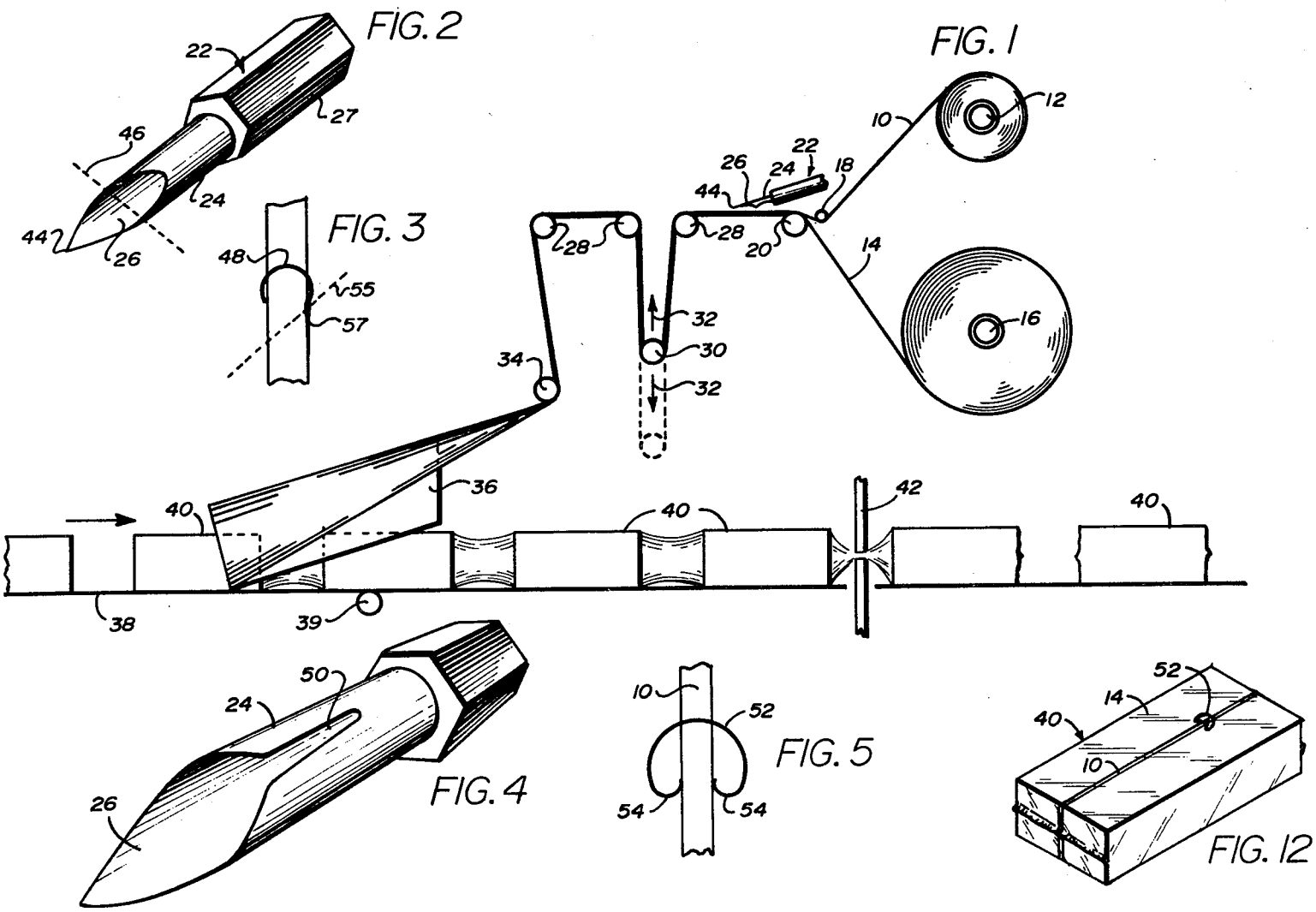
FIG. 1 shows a flow diagram illustrating the method of this invention.
FIG. 2 is a perspective showing one embodiment of the cutter of this invention.
FIG. 3 illustrates a top view of the tab cut achieved by the cutter of FIG. 2.
FIG. 4 shows an alternate cutter.
FIG. 5 is a top view of the tab produced by the cutter of FIG. 4.
FIG. 12 illustrates a wrapped package of this invention.

Referring now to the drawings wherein like numbers signify like parts and more particularly to FIG. 1, a diagramatic representation of the method of this invention is shown wherein tear tape 10 pays off from reel 12 and shrink wrap film web 14 pays off from reel 16. Tape 10 passes under guide roller 20 and thereafter meets film web 14. Film and tape pass over roller, the tape now adhering to the film surface. The bond between tape and film is achieved by simple pressure and is an inherent characteristic of the tape and film as will be explained more fully hereinafter. From guide roller 20, tape and film together pass under punch cutter 22. Punch cutter 22 includes shank 24 and cutting nib 26. Punch cutter 22 is shown mounted at an acute angle of approximately 38° from the horizontal. Details of punch cutter 22 are shown in more detail in subsequent Figures. Punch cutter 22 operates on either a continuous or reciprocal basis, punch cutting tabs from tear tape 10 by penetrating both tape and film.

Punch cutting of tear tabs may be either continuous or reciprocal, the latter method involving the momentary halting of the film to perform the cutting step. While a reciprocal method is satisfactory in some operations, a continuous operation is preferred as more efficient. In reciprocal operations, the cutter is conveniently mounted at right angles to the film/tape surface. However, if the cutter is mounted at right angles in a continuous high speed operation, elongated, unacceptable and sometimes torn tabs result. I have discovered that these undesirable results are eliminated when the cutter is mounted at an angle as shown in FIG. 1. Where the operation is high speed and continuous, the cutter of this invention, if mounted at an angle, may easily perform a hundred cycles per minute with no elongation or tearing of the tab taking place.

The tab-punched tape and film proceed from the punch cutting station, passing over guide roller 28 and proceeding from there to adjustable tab roller 30. Tab roller 30 is also shown in FIG. 1 in phantom position with directional arrows 32 to indicate the positions of adjustment of the tab roller. In operation, a predetermined setting of tab roller 30 will result in the tab appearing on the wrapped package as a matter of preselected choice and the choice may be easily altered or changed. Advancing film and tape proceed from tab roller 30 over guide rollers 28 and guide roller 34 to forming shoe 36 which operates in connection with package conveyor 38 and folds the film so that tape 10 now appears on the film underside while, additionally, infolding the package. Forming shoe 36 is of a type of device conventionally utilized for this purpose and forms no part of this invention. Packages 40 advance on the conveyor 38 to wrapping shoe 36 from which they emerge encased with film and pass over film bottom sealer 39. Wrapped packages then proceed along conveyor 38, passing through sealer bar 42. Sealer bar 42 may be a cross sealer such as Weldotron 1400, or others well known in the art. Sealer bar 42 simultaneously severs film and seals its ends to complete the encasement of package 40. After sealing, package 40 proceeds to a shrink oven, not shown, of the kind ordinarily in normal usage in the art wherein heat is supplied to the wrapped package where the thermoplastic film and tape simultaneously shrink to tightly encase package 40.

Referring now to FIG. 12, details of wrapped package 40 are shown in more detail. Package 40 is shown encased with film 14 and including tear tape 10. Tear tape tab 52 is shown positioned on package 40 near one of its ends. It should be appreciated from the foregoing explanation in regard to FIG. 1 that the position of tear tab 52 may be anywhere along the length of the tape on package 40 and that the variability of the position of tear tab 52 is controlled by adjusting tab roller 30 along the axis as indicated by arrows 32.

Referring now to FIG. 2, punch cutter 22 is illustrated in more detail. Punch cutter 22 includes shank 24 and cutting nib 26 which are shown mounted in holder 27. Punch cutter 22 has an overall superficial appearance of a quill pen. It is formed of a generally cylindrical shank 24 from which a section has either been removed or which never was constructed to thereby form the cutting edge. This section may be a planar section taken through shank 24 at generally an acute angle thereto or the section may be somewhat less than planar whereby a depression or dish-shaped nib is formed as is better illustated in FIG. 4. For the purpose of this explanation, both alternatives are included in the definition of generally planar. It should be appreciated that in the punch cutting step, punch cutter 22 penetrates film and tape with tip 44 first making contact with the tape. Nib 26 (the cutting edge) only extends approximately as far as the area indicated generally by dotted lines 46. A total penetration of the pen up to shank 24 would result in a hole being punctured in the tape in place of the desired tab.

FIG. 3 illustrates the outline of a tab produced by the cutter of FIG. 2. Tear tab 48 is arcuate in shape, approximately semi-circular.

Referring now to FIG. 4, an alternate embodiment of cutter 22 is shown. In the embodiment illustrated in FIG. 4, shank 24 includes slot 50 which runs along the longitudinal axis of the shank. The walls of shank 50, along the edges of the slot, curve inwardly slightly to give a folding appearance.

FIG. 5 illustrates the shape of the tab produced by the cutter of FIG. 4. Tear tab 52 shown in FIG. 5 includes folded portion 54 and the tear tab produced by the cutter of FIG. 4 is superior in many applications. The superiority of tear tab 52 results because folded portion 54 acts to reduce the tangential force at the end of the tab cut. Such reduction of force is important during the film shrinking step as it is during this step that, due to excess tension, a running tear is likely to develop along the film tape intersection. Referring back to FIG. 3, 55 indicates the tangential force and 57 the position the running tear is likely to occur.

Referring now to FIG. 12, wrapped package 40 is shown in detail including tear tape 10 and tear tab 52. Tear tab 52 is shown in FIG. 12 as appearing near one end of package 40. It should be apparent from the foregoing discussion that it is the discretionary positioning of tab roller 30 which will result in the positioning of tear tab 52 at any place on package 40 along tear tape 10 as may be desired.

Figure 6:
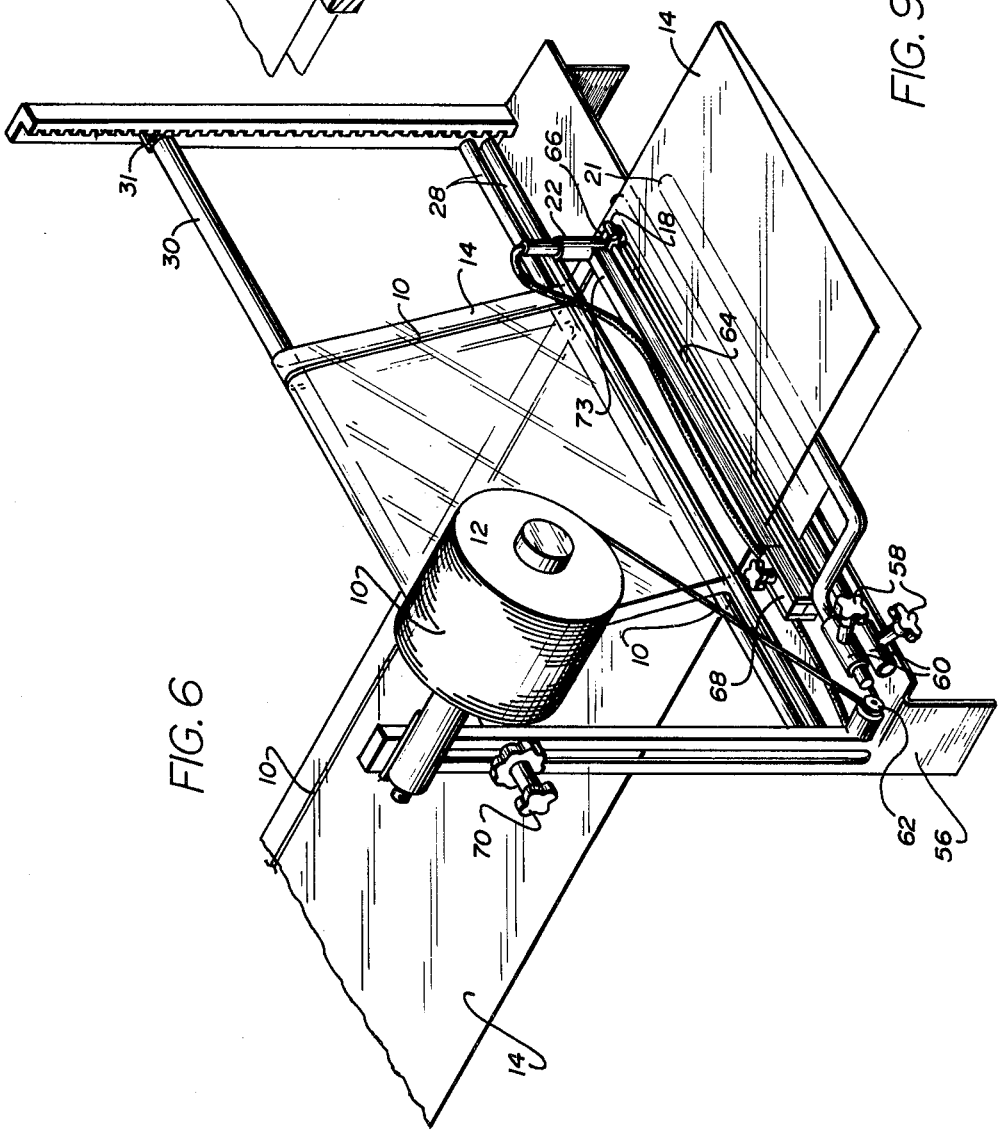
FIG. 6 is an isometric of the apparatus of this invention.

Referring now to FIG. 6, a more detailed view of part of the apparatus of this invention is shown. FIG. 6 illustrates an arrangement of the apparatus particularly suitable for use with film which is center folded. Film strip or web 14 first encounters opener rod 21 mounted in housing 56. As film 14 advances, opener rod 21 allows the film fold to be separated prior to the punch cutting. Tape 10 pays off from reel 12 also shown mounted in housing 56. Tape 10 winds around guide pulley 62 and thereafter passes through guide sleeve 64 where it encounters film web 14. Tape and film pass over support plate 66. Punch cutter 22 is mounted on housing 56 by hinge lock 68. Hinge lock 68 is mounted on punch support arm 73 and functions to allow punch support arm 73 to be raised. The ability to raise arm 73 allows easy access to adjust or start the film. Housing 56 also contains guide rollers 28 under which tape and film advance after the punch cutting operation. The film leaves punch cutter 22, passes under the first guide roller, and over tab roller 30 shown mounted in housing 56 with rack and pinion coupling 31 in which a vertical portion of housing 56 contains the rack portion. Screws 70 hold tab roller 30 in position. The film then passes under the second guide roller 28.

Referring now to FIG. 7, wherein certain parts are omitted to enable numerated parts to be more clearly seen, tape 10 paying off from reel 12 is shown passing under guide pulley 62 and thereafter through tape guide 64. It may be seen that tape guide 64 is a channel whose slot allows for easy access in threading. Tape 10, after emerging from tape guide 64, will mate with shrink wrap film web 14 (not shown) and thereafter pass over support plate 66 across opening 72.

Figure 8:
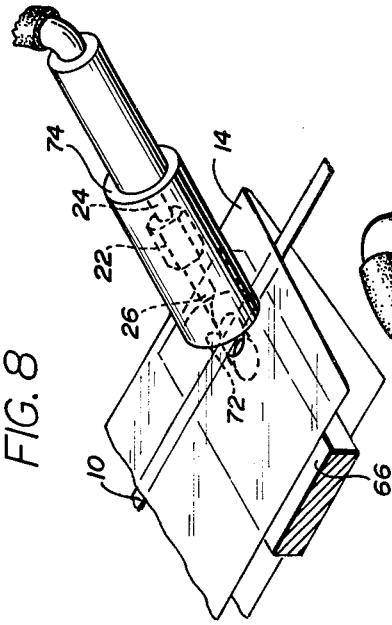
FIG. 8 illustrates an embodiment wherein the cutter is mounted at an acute angle.

Referring now to FIG. 8, more details of the punch cutting apparatus may be seen in that tape 10 is shown across openings 72 as previously described. Nib 26 and shank 24 are shown in phantom in this view. It should be noted that opening 72 in plate 66 is set at an angle to correspond with the angle of the mounting of punch cutter 22.

Figure 9:
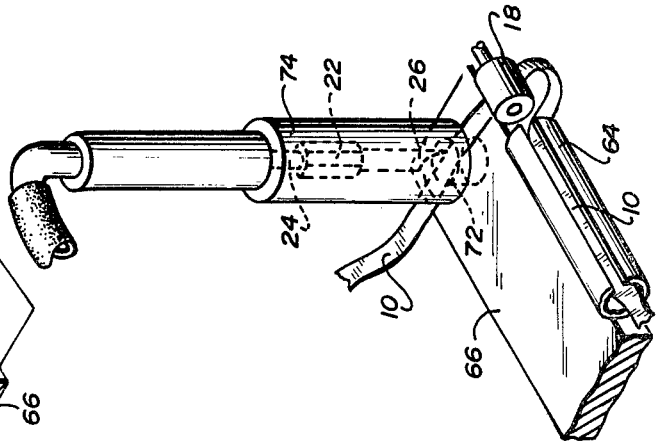
FIG. 9 shows an embodiment of this invention wherein the cutter is mounted at right angles to the film.

Referring now to FIG. 9, an embodiment of this invention is shown in which punch cutter 22 is mounted at right angles to support plate 66. This embodiment is best suited for reciprocating operations as has been previously mentioned. As in FIG. 8, shank 24 and cutting nib 26 are shown in phantom, positioned to make the punch cut in tape 10. Additionally, FIG. 9 also shows pressure wheel 18. Pressure wheel 18 operates to press advancing tape and film together to better achieve adhesion between the two as tape and film advance for the punch cutting step.

Referring now to FIGS. 10 and 11, an alternate embodiment of punch cutter 22 is shown in which punch cutter 22 includes additionally helical spring 76 which surrounds cutter 22 with one end of helical spring 76 attached to the outer wall of shank 24. The other end of the spring secures anchor pad 78. In operation, the embodiment shown in FIGS. 10 and 11 is useful where it is desired to provide additional support for film and tape prior to the punch cutting step. FIG. 10 shows helical spring 76 in a distended, non-tensioned position, the position punch cutter 22 assumes prior to the cutting step. In operation, as punch cutter 22 advances toward film and tape to perform the punch cutting step, the tensioning of helical spring 76 is automatic, triggered by contact with plate 66, and preceeds the punch cutting step. Therefore, pressure on anchor pad 78 increases and, since anchor pad 78 is resting on film 14 and tape 10, anchor pad 78 operates to hold the tape and film securely in place for the subsequent punch cutting.

There are many variations which may be practiced within the scope of this invention. For example, the shrink-wraped film web may be any of several brands of thermo-plastic film which includes the characteristic of shrinkage upon the application of heat. Clysan EHC, a copolymer manufactured by E I Dupont & Nemours Co. is one example of a suitable film for this application. By web is simply meant the film is conveniently supplied as a continuous sheet of material. Likewise, the tear tape suitable for application in this invention must have the characteristics of shrinking during the application of heat. I have found that an unplasticized polyvinyl chloride tear tape of approximately 5/64 inches is satisfactory for most applications. Additionally, it is preferred, although not essential, that the tape has pressure sensitive properties so that it easily adheres to the film on contact. Tape and film are readily available on the market today which generally have these properties.

It is preferred in most operations that the tape appear on the underside of the film after the package is wrapped. By this expedient, tape is less likely to merely pull off the film instead of tearing the film as is intended.

The punch cutter may be pneumatically operated or driven by other means well known in the art. A more efficient process is realized if the punch cutter and sealer bar are synchronized but this is a matter of choice.

There are many advantages to the device and method of this invention. As has been explained, the punch cutter of this invention obviates the need for melt cutting, especially in applications in which the embodiment of FIG. 4 is utilized.

The tab produced by this embodiment produces a tab with reduced premature tear, the tab promotes straight line and reduces lateral tearing of the film during opening.

The tab roller portion of the invention allows variable and complete flexibility in positioning the tab anywhere on the package along the tape line. Although mounting the cutter at right angles is acceptable on many operations, a marked superiority in results is obtained by mounting the cutter at an acute angle. By thus altering the position at which the cutter operates, it has been surprisingly found that elongation of the tab and other undesirable characteristics are eliminated and a further and very important benefit is realized in that punch cutting is now applicable to high speed, continuous operations.

The apparatus and method of this invention are easily adaptable to a variety of packaging needs. The overall unit size is compact, allowing for easy adjustment to areas where there is a problem.

Although the film is shown as a web, the invention works equally well on applications where the film is supplied as a sleeve, in which instance a film separating shoe is utilized ahead of the punch cutting.

Having now described my invention it is not my intention that the foregoing description be a limitation on the scope of the invention, but rather that the scope of the invention be determined only by reasonable interpretation of the claims.

What is claimed is:

1. Apparatus for forming an adjustable tear tape with tab opening means in a continuous shrink wrapper film application comprising:

(a) guide means for positioning an advancing wrapper film web;

(b) guide means for adjustably positioning an advancing continuous tear strip tape against the surface of said advancing film web;

(c) punch cutting means including a proximal longitudinally extending tubular shank and an integral distal nib as a cutting blade, said nib defining a portion of the exposed edges of said shank lying along a surface generally diagonal to the longitudinal axis of said shank, said punch cutting means being positioned at a pre-fixed distance and angle with respect to said film surface so that in operation, advancing film and tape are severed to form a generally arcuate tab at pre-fixed intervals on said film by penetration thereof by said nib;

(d) a support plate co-operating with said cutting means for receiving and positioning said film and tape thereon during punch cutting, said plate including an opening of sufficient size to allow passage therethrough of said punch cutter nib; and, (e) tab roller means mounted to receive and adjustably pre-fix the position of said advancing tab-cut film and tape with reference to an article to be wrapped so that said tab's position on said package may be controlled.

2. Apparatus according to claim 1 wherein said punch cutting means is positioned at right angles to said film surface.

3. Apparatus according to claim 1 wherein said punch cutting means is positioned at an acute angle with respect to said film surface.

4. Apparatus according to claim 2 wherein said acute angle is approximately 38°.

* * * * *